US010393127B2

(12) United States Patent
Nishizawa et al.

(10) Patent No.: US 10,393,127 B2
(45) Date of Patent: Aug. 27, 2019

(54) HOUSING OF FAN MOTOR

(71) Applicants: Toshiya Nishizawa, Tokyo (JP); Haruka Sakai, Tokyo (JP); Jiro Watanabe, Tokyo (JP); Masafumi Yokota, Tokyo (JP)

(72) Inventors: Toshiya Nishizawa, Tokyo (JP); Haruka Sakai, Tokyo (JP); Jiro Watanabe, Tokyo (JP); Masafumi Yokota, Tokyo (JP)

(73) Assignee: SANYO DENKI CO., LTD., Tokyo (JP)

( * ) Notice: Subject to any disclaimer, the term of this patent is extended or adjusted under 35 U.S.C. 154(b) by 152 days.

(21) Appl. No.: 14/483,474

(22) Filed: Sep. 11, 2014

(65) Prior Publication Data

US 2015/0078939 A1 Mar. 19, 2015

(30) Foreign Application Priority Data

Sep. 13, 2013 (JP) ..... 2013-190989
Nov. 21, 2013 (JP) ..... 2013-241106

(51) Int. Cl.
*F04D 19/00* (2006.01)
*F04D 25/06* (2006.01)
(Continued)

(52) U.S. Cl.
CPC ..... *F04D 25/0693* (2013.01); *F04D 19/002* (2013.01); *F04D 25/08* (2013.01);
(Continued)

(58) Field of Classification Search
CPC ..... F04D 19/002–007; F04D 25/08; F04D 29/52–522; F04D 25/06–0606;
(Continued)

(56) References Cited

U.S. PATENT DOCUMENTS 3,310,698 A * 3/1967 Krell ..... H02K 5/04 310/428
3,700,358 A * 10/1972 Papst ..... H02K 7/14 310/67 R
(Continued)

FOREIGN PATENT DOCUMENTS

CN 1191661 C 3/2005
DE 202008006468 U1 8/2008
(Continued)

OTHER PUBLICATIONS

European Search Report dated Feb. 12, 2015 for corresponding EP Patent Application No. 14184153.6.
(Continued)

*Primary Examiner* — Alexander B Comley
(74) *Attorney, Agent, or Firm* — Drinker Biddle & Reath LLP

(57) ABSTRACT

A housing of a fan motor according to the invention includes: board members provided at an interval in a rotational axis direction of a fan; a coupling portion which couples the board members to each other; a protrusion portion which is protruded toward a space other than an air course from the coupling portion, the space being between the board members other than the air courses; and a fixing portion which fixes a terminal that is provided in the protrusion portion and is connected to a wiring from a power source that supplies electricity to a motor. Other member, which crosses in an extending direction of the terminal from the protrusion portion to an edge portion of the board member, is not provided.

6 Claims, 7 Drawing Sheets

(51) Int. Cl.

| | |
|---|---|
| ***F04D 25/08*** | (2006.01) |
| ***F04D 25/12*** | (2006.01) |
| ***F04D 29/42*** | (2006.01) |
| ***F04D 29/52*** | (2006.01) |
| ***F04D 29/64*** | (2006.01) |

(52) U.S. Cl.
CPC ..... *F04D 25/12* (2013.01); *F04D 29/522* (2013.01); *F04D 29/4226* (2013.01); *F04D 29/646* (2013.01)

(58) Field of Classification Search
CPC .... F04D 25/0693; F04D 25/12; F04D 25/166; F04D 29/4226; F04D 29/646
USPC ..... 417/423.14, 410.1, 423.1; 361/695; 439/527, 532, 533
See application file for complete search history.

(56) References Cited

U.S. PATENT DOCUMENTS 4,221,546 A * 9/1980 Papst ..... F04D 29/545 415/207
4,636,669 A * 1/1987 Plunkett ..... F04D 19/002 310/51
5,924,849 A * 7/1999 Kirchgessner ..... F04D 29/601 415/126
6,190,197 B1 * 2/2001 Polgar ..... H01R 13/6315 439/527
6,592,400 B2 * 7/2003 Shy ..... H05K 7/20172 439/527
6,663,416 B2 * 12/2003 Huang ..... H05K 7/20172 361/695
7,811,069 B2 * 10/2010 Fleig ..... F04D 25/0613 417/423.1
2004/0096325 A1 * 5/2004 Weisser ..... F04D 25/08 415/220
2007/0293089 A1 * 12/2007 Lu ..... F04D 25/08 439/620.04
2008/0124234 A1 * 5/2008 Echazarreta ..... F04D 25/08 417/423.14
2012/0257999 A1 * 10/2012 Hsieh ..... F04D 25/0613 417/423.14

FOREIGN PATENT DOCUMENTS

| | | | |
|---|---|---|---|
| DE | 202012012043 | U1 | 2/2013 |
| JP | S64-22896 | U | 2/1989 |
| JP | H5-240191 | A | 9/1993 |
| JP | H10-54386 | A | 2/1998 |
| JP | 20039470 | A | 1/2003 |

OTHER PUBLICATIONS

Japanese Office Action for Japanese Patent Application No. 2013-241106 dated Oct. 4, 2016.
Taiwanese Office Action for Taiwanese Patent Application No. 103131609, dated Jan. 3, 2018.

* cited by examiner

100

100a

HOUSING OF FAN MOTOR

CROSS-REFERENCE TO RELATED APPLICATIONS

This application claims the benefit of Japanese Application No. 2013-190989, filed Sep. 13, 2013 and Japanese Application No. 2013-241106, filed Nov. 21, 2013, both of which are incorporated herein by reference.

BACKGROUND

1. Technical Field

The present invention relates to a housing of a fan motor.

2. Description of Related Art

A fan motor is mainly configured to have a fan, a motor consisting of a magnet, a winding, or a bearing, and a housing etc. Even regarding the fan motor, a smaller size and a lower cost are required similarly to general components. Corresponding to the requests for the smaller size, for example, a connection portion of a terminal which is connected to a power source from the outside is provided in a central part in a spoke which is provided in the housing (refer to Japanese Unexamined Patent Application Publication No. 2003-9470).

SUMMARY

According to the configuration of Japanese Unexamined Patent Application Publication No. 2003-9470, since the connection portion which is connected with the terminal is in the central portion of the housing, the spoke gets larger by a shape of a connector. Accordingly, ventilation resistance increases, and a larger air volume or lower noise is inhibited. In addition, since a groove shape of the spoke in which the connector is disposed has substantially the same size as the connector, there is a problem that an operation of assembling the connector is difficult.

Here, the present invention is made to solve the above-described problem. The invention provides a housing of a fan motor which is excellent in the operation of assembling a lead wire without increasing the ventilation resistance.

A housing of a fan motor according to the present invention includes: two or more board members provided at an interval in a rotational axis direction of a fan; a coupling portion which couples the board members to each other; a protrusion portion which is formed to be protruded toward a space other than an air course from the coupling portion, the space being a space between the board members other than the air course; and a fixing portion which is provided in the protrusion portion and fixes a terminal that is connected to a wiring from a power source that supplies electricity to a motor. In the invention, other member, which crosses in an extending direction of the terminal from the protrusion portion to an edge portion of the board member, is not provided.

In the housing of a fan motor according to the invention, the fixing portion of the terminal which connects the power source that supplies the electricity to the motor is integrally provided with the protrusion portion which is protruded toward a space other than an air course from the coupling portion, the space being a space between the board members other than the air course. For this reason, compared to a case where the connection portion which is connected with the terminal is provided in a central portion, it is possible to prevent ventilation resistance from increasing. In addition, other member is not provided to cross in the extending direction of the terminal from the protrusion portion to an edge portion of the board member. For this reason, it is possible to sufficiently ensure an operation space when the terminal is fixed to the fixing portion and an operation space when the connector from the other side is connected, and it is possible to make an assembly workability excellent.

DETAILED DESCRIPTION

Hereinafter, with reference to the attached drawings, the embodiment of the invention will be described. In addition, the following description does not limit the technical scope or the definition of the terms described by the scope of the claims. Moreover, the dimension ratio of the drawings is exaggerated for convenience of the description, and there is a case where the ratio is different from the real ratio.

Figure 1A:
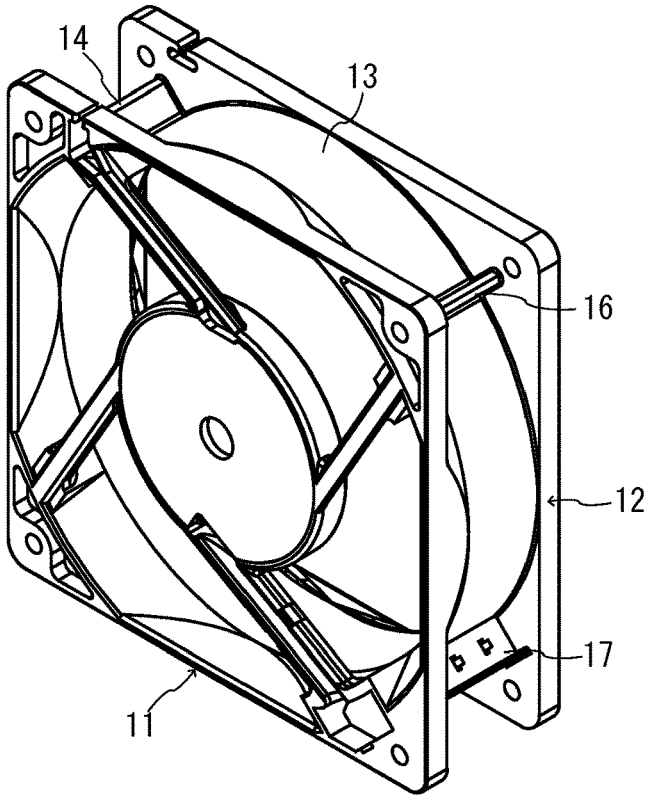
FIG. 1A is a perspective view illustrating a housing of a fan motor according to an embodiment of the invention.
Figure 1B:
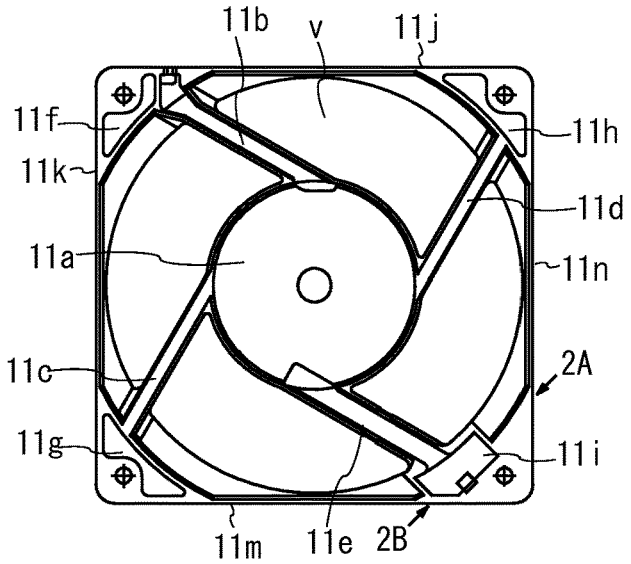
FIG. 1B is a front view illustrating the housing of the same fan motor.
Figure 2A:
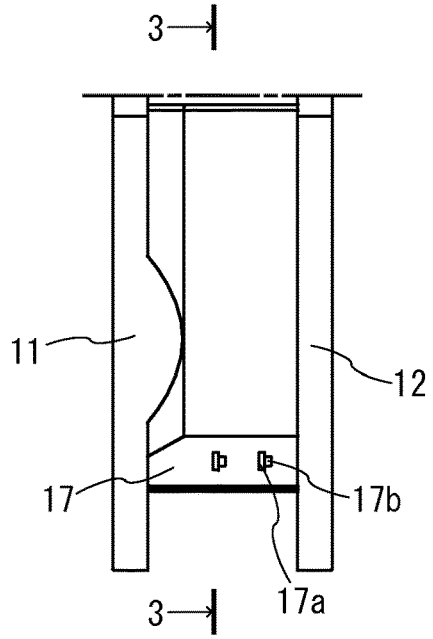
FIG. 2A is an arrow view viewed from a 2A direction of FIG. 1B.
Figure 2B:
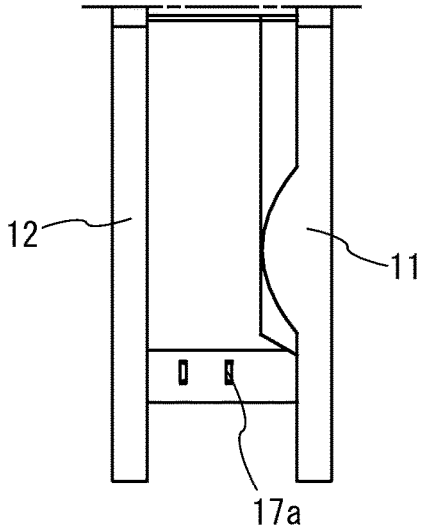
FIG. 2B is an arrow view viewed from a 2B direction of FIG. 1B.
Figure 3:
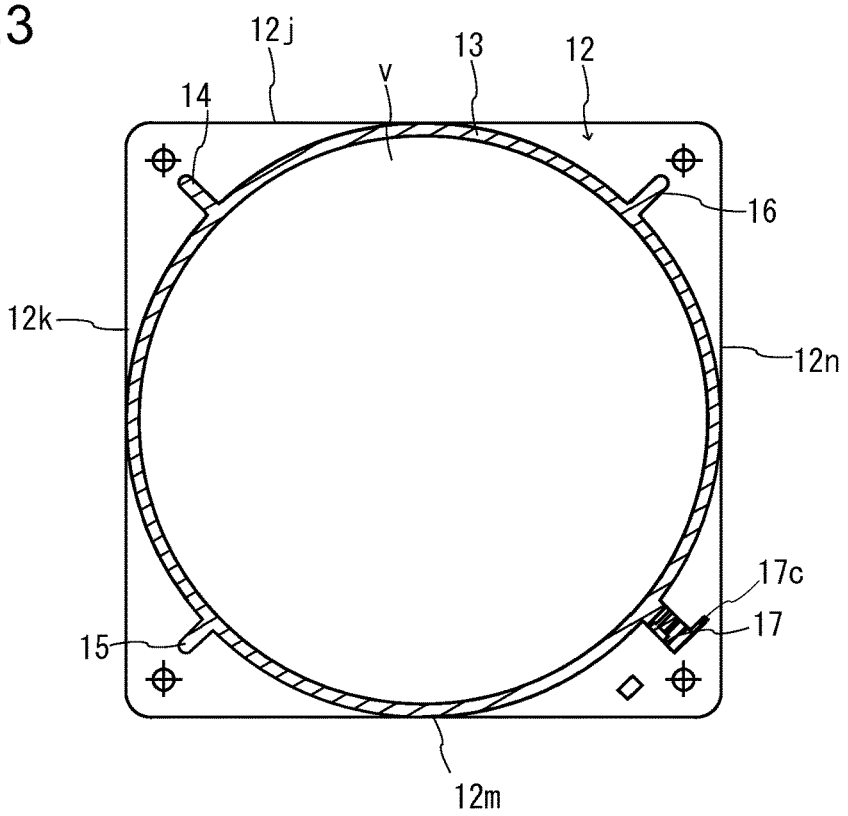
FIG. 3 is a cross-sectional view taken along line 3-3 of FIG. 2A.
Figure 4A:
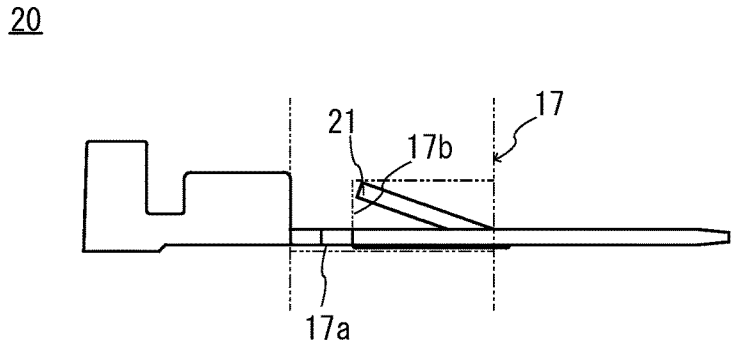
FIG. 4A is a side view illustrating a terminal of a lead wire which is a component of a motor that is mounted to the housing.
Figure 4B:
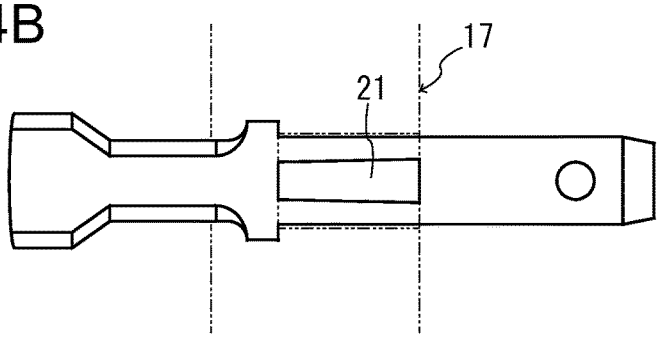
FIG. 4B is a front view illustrating the same terminal.
Figure 5:
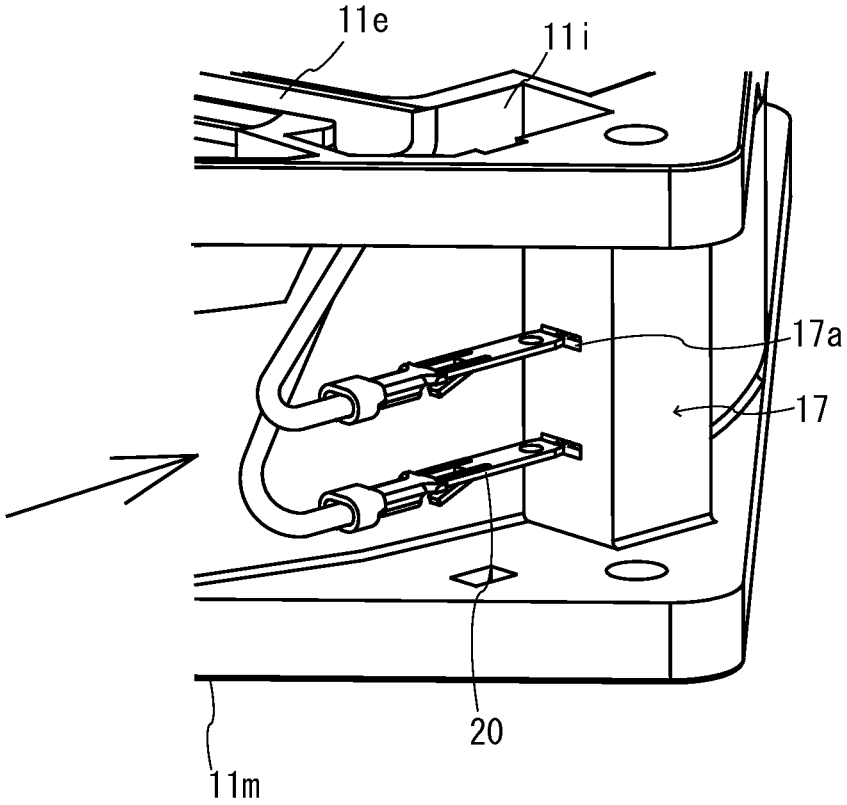
FIG. 5 is an explanatory drawing illustrating a state where the terminal of the lead wire is fixed to the fixing portion.

FIG. 1A is a perspective view illustrating a fan motor according to an embodiment of the invention. FIG. 1B is a front view illustrating the same fan motor. FIG. 2A is an arrow view viewed from a 2A direction of FIG. 1B. FIG. 2B is an arrow view viewed from a 2B direction of FIG. 1B. FIG. 3 is a cross-sectional view taken along line 3-3 of FIG. 2A. FIG. 4A is a side view illustrating a terminal of a lead wire which is a component of a motor that is mounted to the housing. FIG. 4B is a front view illustrating the same terminal. FIG. 5 is an explanatory drawing illustrating a state where the terminal of the lead wire is fixed to the fixing portion.

In a schematic description with reference to FIGS. 1A to 5, a housing 100 of the fan motor according to the embodiment includes board members 11 and 12 provided at an interval in a rotational axis direction of the fan, a coupling portion 13 which couples the board members 11 and 12, and protrusion portions 14, 15, 16, and 17 which are formed to be protruded from the coupling portion 13. A terminal 20 which is connected with a power source is provided in the protrusion portion 17 among the protrusion portions 14, 15, 16, and 17, and the protrusion portion 17 is configured as a fixing portion.

The board members 11 and 12 are members in a rectangular shape, for example, and are provided at both end portions of the rotational axis direction of the fan in the housing 100. The board members 11 and 12 are configured to be in the same shape. In FIG. 1A, a motor mounting portion 11*a*, which has a circular shape, for installing the fan or the motor in the board member 11 is formed in the central portion. In addition, in the board member 11, spokes 11*b*, 11*c*, 11*d*, and 11*e* (corresponding to board member reinforcement portions) are formed elongating to be in contact with the circular mounting portion 11*a* from each rectangular vertex.

Cross-sectional shapes of the spokes 11*b*, 11*c*, 11*d*, and 11*e* are formed in a rectangular shape. The cross-sectional shapes of the spokes 11*b* and 11*e* are further formed in a groove shape, and the cross-sectional shapes of the spokes 11*c* and 11*d* are formed to be solid. In addition, corners 11*f*, 11*g*, 11*h*, and 11*i* of four vertices of the board member 11 are close to the rectangular vertices, and are disposed outside a region which is occupied by the rotation of the fan. In addition, the inside of the corners 11*f*, 11*g*, and 11*h* are not solid, and are formed to be non-through hollows. The corner 11*i* communicates with the groove shape of the spoke 11*e*, and is formed so that the hollowed shape penetrates to a surface of an opposite side of the board member 11. In the mounting portion 11*a* of the board member 11, the motor is mounted, and the lead wire from a circuit substrate of the motor is wired. However, the wiring passes through the groove shape of the spoke 11*e*, and is fixed by the protrusion portion 17 (fixing portion) formed at a side portion of a housing 100 via a penetrating shape of the corner 11*i*. In addition, reference numerals 11*j*, 11*k*, 11*m*, and 11*n* are edge portions of the board member 11.

The coupling portion 13 is a member which couples the board members 11 and 12, and is configured in a substantially cylindrical shape of the hollow in the embodiment. However, the shape is not limited thereto. The protrusion portions 14, 15, 16, and 17 are disposed in a space between the board members and a space other than an air course v, and are formed to be protruded toward the space other than the air course v from the coupling portion 13. Each of the protrusion portions 14, 15, 16, and 17 has a rib shape by coupling the board members 11 and 12, and the ribs extend radially toward the vertices of the board members 11 and 12 from the outside surfaces of the coupling portion 13 as illustrated in FIG. 3.

The protrusion portion 17 fixes the terminal 20 of the lead wire and constitutes a part (fixed portion) which is connected to the connector or the like from the power source. As illustrated in FIG. 2B, in the protrusion portion 17, an insertion hole 17*a* (corresponding to a hole portion) in a rectangular shape is formed, and the terminal 20 is inserted thereto and fixed. In addition, as illustrated in FIG. 2A, an engagement portion 17*b* is formed in the insertion hole 17*a*. As illustrated in FIG. 4A, at a side portion of the terminal 20, an engagement portion 21 which is deformable by elasticity of a material is formed. As the engagement portion 21 is locked (stuck) with the engagement portion 17*b* of the fixing portion, the terminal 20 is prevented from coming out from the fixing portion. In addition, other members (shape), such as a protrusion portion, are not provided from the protrusion portion 17 to an edge portion 11*m* and an edge portion 11*n* of the board member 11.

Next, an operation and effect of the embodiment will be explained. In the traditional housing of the fan motor, connection with the wiring from the outside power source is performed at the mounting portion which is formed at the center of the housing, and the connector is relatively large. For this reason, the ventilation resistance increases, and larger air volume or lower noise is inhibited. In addition, the size of the groove shape of the spoke has almost no difference from that of the connector. Then, even though the shape of the fan motor can be made compact, the assembling operation of the connector is difficult.

Meanwhile, in the embodiment, the fixing portion of the terminal which connects the power source that supplies the electricity to the motor is integrally provided with the protrusion portion 17 which is the space between the board member 11 and the board member 12 and the space other than the air course and is protruded toward the space other than the air course from the coupling portion 13. For this reason, compared to a case where a terminal block is mounted as a separate component, the assembling operation of the terminal block can be unnecessary as the terminal block is integrally configured. In addition, by making the protrusion portion 17 protruded toward the space other than the air course from the coupling portion 13, the increase of the ventilation resistance can be prevented compared to a case where the connection portion that is connected with the terminal is provided in the central portion of the housing. In addition, other members, such as protrusion portions, which cross in the extending direction of the terminal 20 from the protrusion portion 17 to the edge portions 11*m* and 11*n* of the board member 11 near to a side where the connector of the side where the terminal 20 is inserted and the other side is connected, are not provided. For this reason, it is possible to sufficiently ensure an operation space when the terminal 20 is inserted and an operation space when the connector from the other side is inserted, and to make an assembling workability of the terminal excellent.

In addition, the protrusion portions 14, 15, 16, and 17 have a rib which is connected to the board members 11 and 12. The protrusion portion 17 has the insertion hole 17*a* formed on the rib. For this reason, it is possible to mount the terminal 20 to the insertion hole 17*a* and make the protrusion portion as the fixing portion, to use the protrusion portion both as the reinforcement portion of the housing 100 and the fixing portion of the terminal 20, and to make the shape of the housing 100 simple and excellent in manufacturability.

In addition, the board member 11 has a motor mounting portion 11*a* which mounts the motor, and the spokes 11*b*, 11*c*, 11*d*, and 11*e* which extend to the corners 11*f*, 11*g*, 11*h*, and 11*i* of the board member 11 from the motor mounting portion 11*a*. The spoke 11*e* is configured to be able to accommodate the wiring which extends from the circuit substrate of the motor. For this reason, even when the fan rotates, the wiring is protected by the spoke 11*e*, and a crack failure or the like can be prevented.

In addition, the groove shape of the spoke 11*e* communicates to the surface of the opposite side of the board member 11. For this reason, even when the housing 100 is installed to be upright, without making the board members 11 and 12 step on the wiring, it is possible to route the wiring to the fixing portion, and to realize a stylish outer appearance of the wiring.

Moreover, the invention is not limited to the above-described embodiment, and various modifications are possible within the scope of the claims.

In the description above, an embodiment, in which the cross-sectional shapes of the spokes lib, 11*c*, 11*d*, and 11*e* are rectangular, is explained. However, the invention is not limited thereto, and the cross-sectional shape may be circular. In addition, the disposition and the number of the protrusion portions are not limited to the above-described embodiment, and the extending direction of the protrusion portion is also not limited to a radial direction and may be a horizontal direction or an vertical (perpendicular) direction. In addition, the protrusion portion may be formed to be protruded from the coupling portion 13 in a state where the protrusion portion does not connect the board members 11 and 12. In addition, the shape of the board members 11 and 12 from a planar view may not be rectangular, and the shape of the board members 11 and 12 from a planar view may not be the same shape if the installation surface is stable.

In the above, an embodiment, in which other members (shape), such as a protrusion portion, are not provided from the protrusion portion 17 which functions as the fixing portion to an edge portion 11*m* or an edge portion 11*n* of the board member 11, is explained. However, other shapes maybe provided as far as mounting the connector of a plug cord mounted in the protrusion portion 17 which functions as the fixing portion is not inhibited, and such a case also can be included in the scope of the invention.

Figure 6:
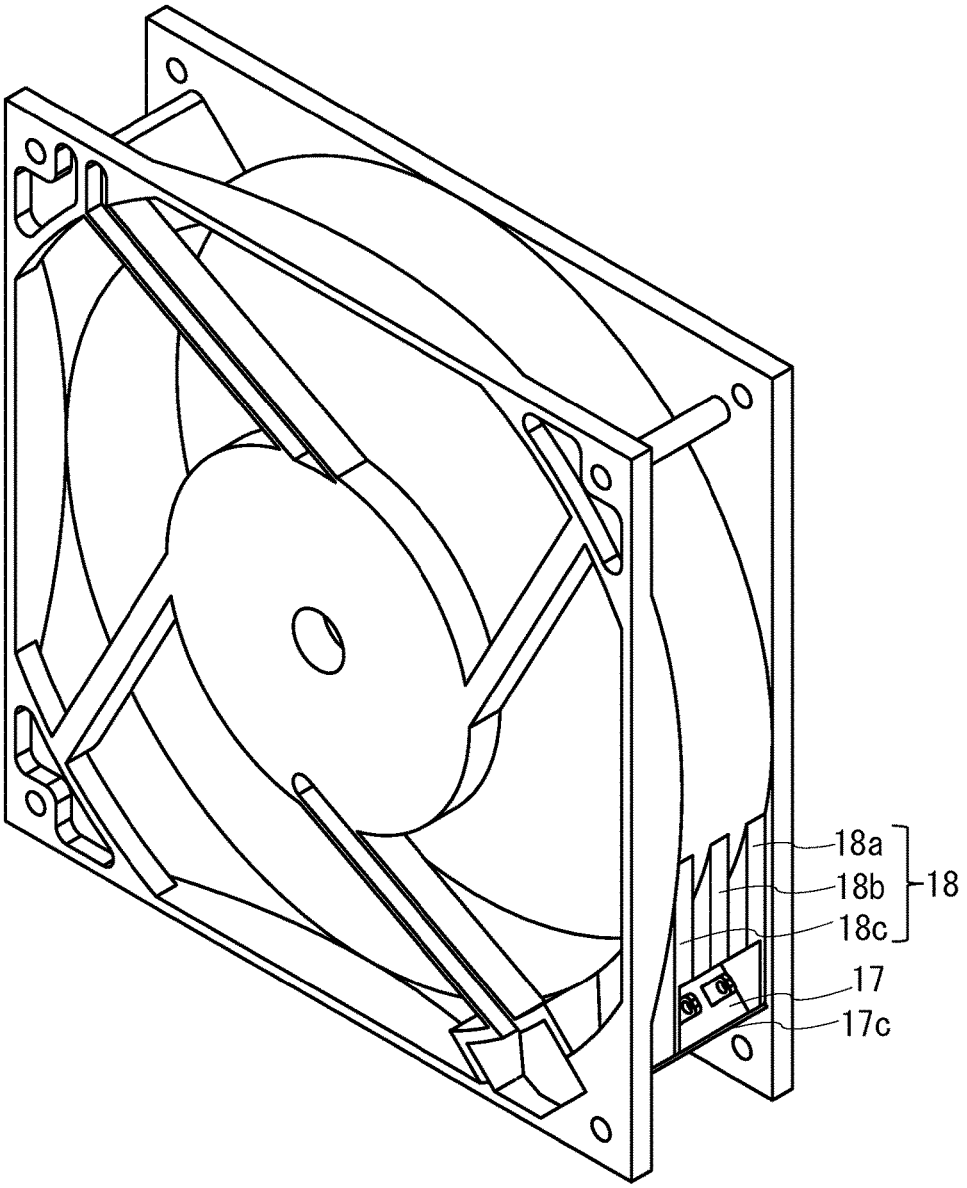
FIG. 6 is a perspective view illustrating the housing of the fan motor according to a modification of the invention.
Figure 7:
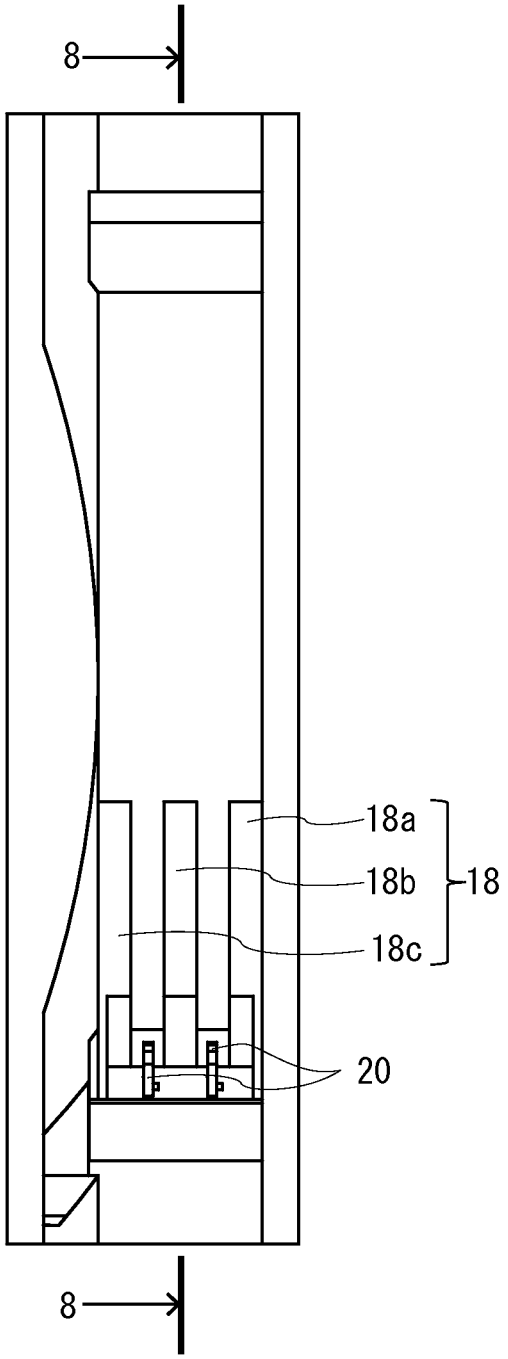
FIG. 7 is a right-side view illustrating the same fan motor.
Figure 8:
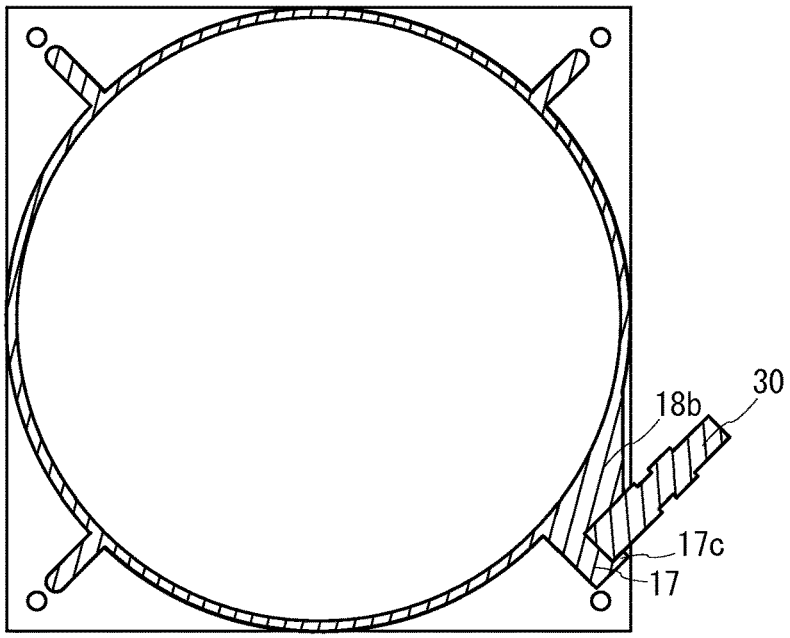
FIG. 8 is a cross-sectional view taken along line 8-8 of FIG. 7.
Figure 9:
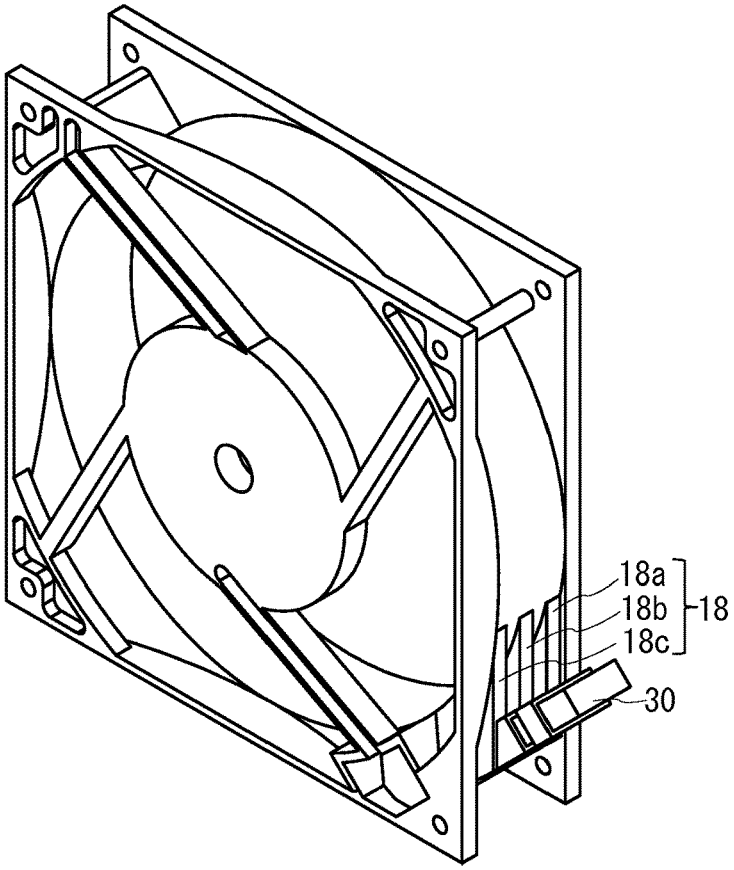
FIG. 9 is a perspective view illustrating a status in which the connector is mounted to the same fan motor.

FIG. 6 is a perspective view illustrating the housing of the fan motor according to a modification of the invention. FIG. 7 is a right-side view illustrating the same fan motor. FIG. 8 is a cross-sectional view taken along line 8-8 of FIG. 7. FIG. 9 is a perspective view illustrating a state in which the connector is mounted to the same fan motor. In the housing 100*a* of the fan motor illustrated in FIGS. 6 and 7, in the protrusion portion 17 which functions as the fixing portion, a rib 18 (corresponding to the fixing portion of the connector) is formed at a side where a tip of the terminal 20 is protruded. The rib 18 is configured to have ribs 18*a*, 18*b*, and 18*c* which are disposed at the interval in an axial direction of a housing 100*a* of the fan motor, but the number of the ribs is not limited to FIGS. 6 and 7.

In the ribs 18*a*, 18*b*, and 18*c*, the rib shape is cut out in conformity to the shape of the connector 30 of the plug cord mounted in the terminal 20. As illustrated in FIG. 8, the ribs 18*a*, 18*b*, and 18*c* are formed to be coupled with the protrusion portion 17. As illustrated in FIGS. 8 and 9, the cut-out shapes in the ribs 18*a*, 18*b*, and 18*c* are formed along the insertion direction of the connector 30. In a lateral direction (axial direction of the fan motor) illustrated in FIG. 7, as the shape of the ribs 18*a* and 18*c* is cut out in conformity to the shape of the connector 30, it is possible to suppress backlash of the connector 30 in the horizontal direction of FIG. 7.

In addition, in the protrusion portion 17, as illustrated in FIGS. 3 and 8, a projection 17*c* which is protruded in a protrusion direction of the terminal 20 is formed to touch the shape of the connector 30 of the plug cord. In addition, the ribs 18*a*, 18*b*, and 18*c* are cut out in conformity to the shape of the connector 30 even in a perpendicular direction (direction which crosses with the axial direction of the fan motor) illustrated in FIG. 7. In such a manner, as the projection 17*c* and the ribs 18*a*, 18*b*, and 18*c* are formed in conformity to the shape of the connector 30, it is possible to suppress the backlash in a longitudinal direction in FIG. 7 when the connector 30 is mounted on the protrusion portion 17.

By forming the ribs 18*a*, 18*b*, and 18*c*, and the projection 17*c* in such a manner, it is possible to prevent the backlash in the perpendicular direction and in the horizontal direction in FIG. 7 when the connector 30 is mounted. In addition, by suppressing the backlash of the connector 30 by the ribs 18*a*, 18*b*, and 18*c*, it is possible to prevent a disconnection of the connector 30 which is generated by the backlash. In addition, the shape of the ribs 18*a*, 18*b*, and 18*c* may not be configured as the cut-out shape if it is possible to prevent the backlash of the connector 30 by touching the connector 30 as the projection 17*c*. The suppression of the backlash of the connector 30 by the rib 18 may be in either of the perpendicular direction or the horizontal direction in FIG. 7, and may be an oblique direction other than the above-described directions.

In addition, by coupling the shapes of ribs 18*a*, 18*b*, and 18*c* with the protrusion portion 17, and by extending the connector 30 in the insertion direction from the protrusion portion 17, it is possible not only to fix the connector 30 and to suppress the backlash, but also to be a guide shape for inserting the connector 30. Accordingly, it is possible to improve the mounting workability of the connector. In addition, similarly to the description above, if the insertion of the connector 30 is guided, the rib 18 may not have the cut-out shape.

In the application, based on Japanese Patent Application No. 2013-190989 applied on Sep. 13, 2013, and Japanese Patent Application No. 2013-241106 applied on Nov. 21, 2013, the disclosed content thereof is referred to and incorporated as a whole.

What is claimed is:

1. A housing of a fan motor, comprising: two or more board members provided at an interval in a rotational axis direction of a fan; a coupling portion which has a hollow cylindrical shape and couples the two or more board members to each other; a protrusion portion which is monolithically formed to the coupling portion and which protrudes radially toward a space outside an air course from an outer surface of the coupling portion, the space being a space between the board members outside the air course; a fixing portion which fixes a terminal that is provided in the protrusion portion and which is connectable to wiring from a power source that supplies electricity to a motor, and a connector fixing portion which touches a connector and fixes the connector when the connector is connected with respect to the terminal fixed to the fixing portion; wherein; the fixing portion is integrally provided within the protrusion portion, the protrusion portion is formed as a first rib which couples the board members to each other; the fixing portion includes a hole portion which is formed on the first rib; and the connector fixing portion includes at least three second ribs disposed in the rotational axis direction external to the fixing portion which extend between the board members and which are configured to have a shape cut out in accordance with a shape of the connector; wherein the at least three second ribs are formed to be protruded directly from the coupling portion and are disposed at an interval in the rotational axis direction of the fan; wherein the at least three second ribs are parallel to one another and extend along the coupling portion; wherein the housing of a fan motor further comprises a projection provided to the fixing portion to protrude in a protruding direction of the terminal, the projection being configured on an end of the fixing portion opposite the coupling portion to touch and fix the connector together with the connector fixing portion.

2. The housing of a fan motor according to claim 1,
wherein the housing includes
a motor mounting portion which mounts the motor on the board member, and
a board member reinforcement portion which reinforces the board member and extends from the motor mounting portion, and
wherein the board member reinforcement portion has a groove shape.

3. The housing of a fan motor according to claim 2,
wherein the groove shape in the board member reinforcement portion communicates with the fixing portion.

4. The housing of a fan motor according to claim 1, wherein the connector fixing portion is formed to be coupled with the fixing portion.

5. The housing of a fan motor according to claim 1, wherein there are three second ribs disposed in the rotational axis direction between the board members configured to have a shape cut out in accordance with the shape of the connector.

6. The housing of a fan motor according to claim 1, wherein at least three second ribs are integrally configured with the coupling portion.

* * * * *